United States Patent [19]

Ando et al.

[11] 4,220,891

[45] Sep. 2, 1980

[54] DIRECTLY HEATED CATHODE FOR ELECTRON TUBE

[75] Inventors: Hisashi Ando; Ko Soeno; Hiroshi Sakamoto, all of Hitachi; Testuo Oyama, Takahagi; Takao Kawamura; Hiroshi Fukushima, both of Chiba, all of Japan

[73] Assignee: Hitachi, Ltd., Japan

[21] Appl. No.: 25,582

[22] Filed: Mar. 30, 1979

[30] Foreign Application Priority Data

Apr. 5, 1978 [JP] Japan ..... 53-39202

[51] Int. Cl.[2] ..... H01J 1/14; H01J 19/06

[52] U.S. Cl. ..... 313/345; 313/346 R

[58] Field of Search ..... 313/345, 346 R

[56] References Cited

U.S. PATENT DOCUMENTS 3,374,385 3/1968 Lattimer ..... 313/345 X 4,079,164 3/1978 Misumi ..... 313/345 X 4,081,713 3/1978 Misumi ..... 313/346 R

*Primary Examiner*—Alfred E. Smith

*Assistant Examiner*—Charles F. Roberts

*Attorney, Agent, or Firm*—Craig & Antonelli

[57] ABSTRACT

A directly heated cathode for electron tube having a stable electron emission characteristic and a low cut-off voltage is provided. The cathode comprises a base metal of an alloy consisting essentially of 20–30% by weight of tungsten and a trace amount to 0.25% by weight of zirconium, the balance being nickel, binder dots of metallic nickel powders distributed on a flat part at the front side of the base metal, and a layer of thermoelectron emission oxides laid on the flat part at the front side of the base metal. The layer of thermoelectron emission oxides is in direct contact with the flat part through clearances among the binder dots of the metallic nickel powders.

6 Claims, 6 Drawing Figures

DIRECTLY HEATED CATHODE FOR ELECTRON TUBE

This invention relates to a directly heated cathode for electron tube, and more particularly to an improved directly heated cathode for electron tube, which comprises a cathode base metal of tungsten-zirconium-nickel alloy, and a thermoelectron emission oxide layer formed on a flat part of the base metal through binder dots of metallic nickel powders distributed on the flat part of the base metal.

Recently, in the field of camera tube, various cathode-ray tubes, television picture tubes, etc., development of the so called quick start electron tubes capable of being put in operation within about one second after an electron source switch is turned on have been in demand, and directly heated cathodes have been proposed in place of the conventional indirectly heated cathodes. The directly heated cathode is comprised of a layer of thermoelectron emission oxides such as alkaline earth metal oxides formed on a flat part of a cathode base metal comprising a heat-resistant alloy, where thermoelectrons are made to be emitted from the oxides by directly passing an electric current between the flat part of leg parts of the base metal.

Main characteristics required for the cathode base metal are given as follows:

(a) Sufficient and stable electron emission can be effected for a long period of time. For example, electron emission after 20,000 hours must not be less than 70% of the initial electron emission.

(b) A fluctuation in cut-off voltage must be small. For example, a fluctuation in the cut-off voltage must be within 2 V.

(c) No peeling of the alkaline earth metal oxides (Ba.Sr.Ca)O must be brought about.

(d) Since the base metal is a resistor, a specific resistance at the normal temperature must be more than 50 $\mu\Omega$-cm and a specific resistance at 800° C. must be more than 80 $\mu\Omega$-cm.

(e) Strength at an elevated temperature such as 800°-900° C. must be more than 15 kg/mm$^2$.

(f) A base metal can be prepared by powder metallurgy and has a good sintering property.

(g) A base metal has a good cold rolling property, and can be reduced to a thickness of less than 50 $\mu$m with a fluctuation in thickness of less than 5%.

Base metals of tungsten-nickel based alloy are proposed in Japanese Patent Publication No. 21008/69, Japanese Laid-open Patent Application Nos. 57771/77 and 108770/77 and U.S. Pat. Nos. 4,079,164 and 4,081,713 from the foregoing viewpoints.

Japanese Patent Publication No. 21008/69 discloses addition of an impurity amount of zirconium, silicon, aluminum, etc. as a reducing agent to a tungsten-nickel alloy, but the proposed base metal has no function to maintain electron emission over a longer period of time.

Japanese Laid-open Patent Application No. 57771/77 discloses a comparative example of using a cathode base metal of an alloy containing 0.4% zirconium, applying nickel powders onto the entire surface of the flat part, followed by baking, and forming an oxide layer on the nickel layer. However, the thermoelectron emission characteristics of the cathode has various problems.

Japanese Laid-open Patent Application No. 108770/77 discloses a cathode prepared by forming a nickel plated layer on the entire surface of the flat part or the entire base metal, followed by heat diffusion, and then forming a layer of nickel powders. However, the plated layer has no good effect upon the thermoelectron emission characteristics. That is, such a diffusion layer is not required for the thermoelectron emission characteristics.

U.S. Pat. No. 4,079,164 discloses a base metal for directly heated cathode, comprising an alloy of 20-30% by weight of tungsten and 0.05-5% by weight of zirconium, the balance being nickel, but the base metal has problems in the stability of electron emission characteristics and cut-off voltage.

U.S. Pat. No. 4,081,713 discloses deposition of nickel powders on both sides of the flat part of base metal to balance a thermal deformation, but the base metal still has a possibility of a wave-like deformation.

An object of the present invention is to provide a directly heated cathode for electron tube having a good thermoelectron emission characteristics for a longer period of time and a low cut-off voltage.

The present invention provides a directly heated cathode for electron tube, which comprises a base metal of an alloy consisting essentially of 20-30% by weight of tungsten and a trace amount to 0.25% by weight of zirconium, the balance being nickel, binder dots of metallic nickel powders distributed on a flat part at the front side of the base metal, and a layer of thermoelectron emission oxides laid on the flat part at the front side of the base metal, the layer of thermoelectron emission oxides being in direct contact with the flat part through clearances among the binder dots of metallic nickel powders. The present directly heated cathode has a low cut-off voltage $\Delta E_{co}$ due to less thermal deformation, and a high thermoelectron emission over a longer period of time.

The present invention will be described in detail below, referring to the accompanying drawings and embodiments.

Figure 1:
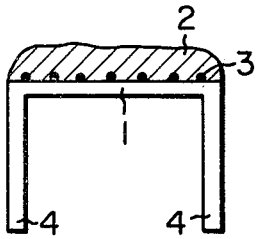
FIG. 1 is a cross-sectional side view showing the structure of a directly heated cathode for electron tube according to the present invention.

In FIG. 1, a cathode base metal is made of leg parts 4 and a flat part 1 of an alloy consisting essentially of 20-30% by weight of tungsten and a trace amount to 0.25% by weight of zirconium, the balance being nickel. The cathode base metal is usually prepared by sintering raw material metal powders or compound powders, rolling the resulting sintered product to a sheet, blanking the sheet to a desired configuration, and shaping the blanked sheet to a cathode form.

An alkaline earth metal oxide layer 2 such as (Ba.Sr.Ca)O, etc. is formed as a thermoelectron emission oxide layer on a front side of the flat part 1. The oxide layer 2 is baked onto the flat part through binder dots of metallic nickel powders distributed in advance on the front side of the flat part. The binder dots of metallic nickel powders serve to firmly bind the oxide layer 2 to the flat part 1, and since the binder dots of metallic nickel powders are distributed in a discontinued manner, the oxide layer can be brought in direct contact with the oxide layer through clearances among the binder dots of metallic nickel powders. When the metallic nickel powders are formed on the flat part so as to cover the entire surface of the flat part, a compound oxide of the alkaline earth metal oxides used as the oxides and zirconium in the base metal is formed, which deforms the cathode and lowers the thermoelectron emission characteristics within a short time. To overcome such problems, the metallic nickel powders are distributed dot-wise on the flat part and baked to form binder dots in the present invention. The rate of the nickel powders to be distributed is 0.1–5 mg/cm$^2$, preferably 0.5–2 mg/cm$^2$.

Very fine metallic nickel powders are used in the present invention, and in the field of electron tubes, metallic nickel powders having sizes of 4–7 μm produced by Inco, USA are widely used, which have a high purity and are preferable to use in the present invention. The particle size of metallic nickel powders is, of course, not limited to said range.

The fine metallic nickel powders can be distributed dot-wise on the flat part by spraying. This is, the metallic nickel powders are mixed with a dispersion medium such as butyl acetate together with a binder such as nitrocellulose or methyl cellulose, and then the resulting dispersion is sprayed dotwise on the flat part.

It is known that a tungsten-nickel alloy containing 20–30% by weight of tungsten is suitable for the cathode base metal, where the range of tungsten content is selected for the following reasons. When the tungsten content is less than 20% by weight, the specific resistance of the alloy at the normal temperature will be less than 50 μΩ-cm, and the specific resistance at 800° C. will be less than 50 μΩ-cm. Thus, the function as a heater is not sufficient, and the quick start of the directly heated cathode is retarded. When the tungsten content is also less than 20% by weight, the strength of the alloy at an elevated temperature, for example, 800° C. will be less than 15 kg/mm$^2$, and the cathode will be deformed at the elevated temperature, making the life of the cathode shorter.

When the tungsten content exceeds 30% on the other hand, an intermetallic compound of nickel and tungsten is formed, and cracks are developed at the cold rolling even in only a few percent reduction ratio. That is, a satisfactory sheet cannot be obtained. A preferable tungsten content is 26–29% by weight.

The tungsten-zirconium-nickel alloy can be prepared preferably by powder metallurg. When an alloy containing tungsten having a higher specific gravity and a higher melting point than those of nickel as a matrix is prepared by melting, it is difficult to produce a homogeneous molten mixture. Even if the homogeneous molten mixture can be produced, tungsten is segregated at the solidification. When the molten mixture is rapidly cooled to prevent the segregation of tungsten at the solidification, cracks will develop on the material. On the other hand, the powder metallurg has no such problem. To prevent oxidation of the material at sintering, vacuum sintering must be carried out at 1,350° C., for example, in an atmosphere kept in vacuum of about $5\times10^{-5}$ torr.

The resulting sintered material is then subjected to at least one cold rolling and at least one vacuum annealing to prepare a sheet.

The sheet having a thickness of, for example, 40 μm, prepared by said cold rolling and vacuum annealing is blanked to obtain base metal pieces of desired configuration. Nickel powders having particle sizes of 2–7 μm are deposited dot-wise on the flat part of the base metal piece (area: 1 mm$^2$) at a rate of about 1.5 mg/cm$^2$ by spraying, and vacuum-baked at 900° C. and $5\times10^{-5}$ torr for 30 minutes. After cooling, alkaline earth metal carbonates $(Ba.Sr.Ca)CO_3$ are deposited on the base metal piece by spraying, and the resulting cathode piece is inserted and sealed in an electron tube. The base metal piece is heated by direct current passage therethrough while exhausting the electron tube to a vacuum, whereby $(Ba.Sr.Ca)CO_3$ is converted to (Ba.Sr.Ca)O. The cathode is then bent at leg parts 4 to obtain a directly heated cathode form illustrated in FIG. 1.

Figure 2:
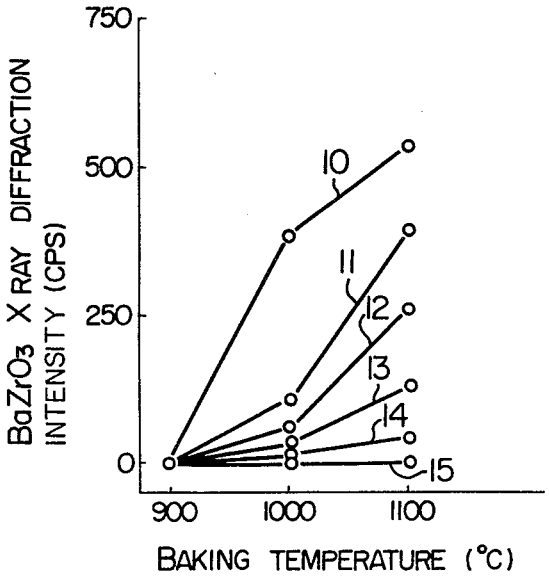
FIG. 2 is a diagram showing relations between a baking temperature of thermoelectron emission oxides and an X-ray diffraction intensity of $BaZrO_3$.

In FIG. 2, relations between an oxide baking temperature of test pieces prepared from the alloys shown in Table 1 and X-ray diffraction intensity (CPS). That is, relations between a zirconium content of the test piece alloy and an amount of $BaZrO_3$ formed are shown. The test pieces used are sheets (20 mm×20 mm), on which metallic nickel powders are dot-wise baked at a rate of 1.5 mg/cm$^2$, and then (Ba.Sr.Ca)O is baked for 0.5 hours.

Table 1

| | W | Zr | Ni |
|---|---|---|---|
| Curve 10 | 28% | 1.6% | balance |
| Curve 11 | " | 0.9% | " |
| Curve 12 | " | 0.68% | " |
| Curve 13 | " | 0.35% | " |
| Curve 14 | " | 0.2% | " |
| Curve 15 | " | 0% | " |

X-ray diffraction conditions:
Target Copper
Tube voltage 40 kV
Tube current 40 mA
Slit system 1°–1°–0.3 mm
Scanning speed ½°/min.

It is obvious from FIG. 2 that the amount of $BaZrO_3$ is increased with increasing zirconium content of base metal alloy. Once $BaZrO_3$ is formed, the electron emission of the cathode is decreased, and thus the amount of $BaZrO_3$ formed must be as small as possible.

Figure 3:
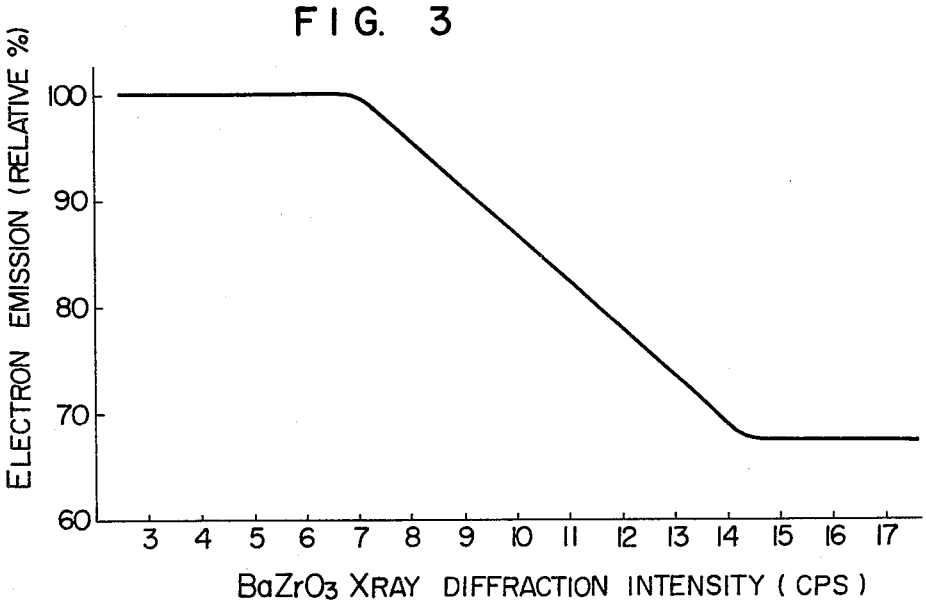
FIG. 3 is a diagram showing relations between an X-ray diffraction intensity of $BaZrO_3$ and electron emission (relative %).

In FIG. 3, relations between X-ray diffraction intensity of $BaZrO_3$ and electron emission (relative %) are shown. Test pieces used in the test have a structure as shown in FIG. 1, and the size of the flat part is 1.2 mm in diameter. The binder dots of metallic nickel powders and the oxide layer are prepared in the same manner as described before.

It is obvious from FIG. 3 that the electron emission is lowered with increasing amount of $BaZrO_3$.

Figure 4A:
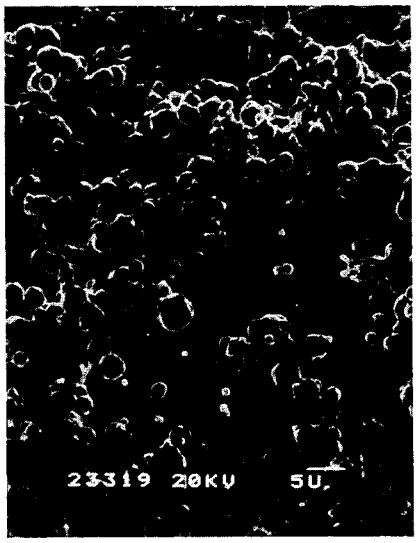
FIG. 4(*a*) is a microscopic picture of nickel powders baked on a base metal, and FIG. 4(*b*) a microscopic picture showing a state of $BaZrO_3$ formed on the base metal.
Figure 4B:
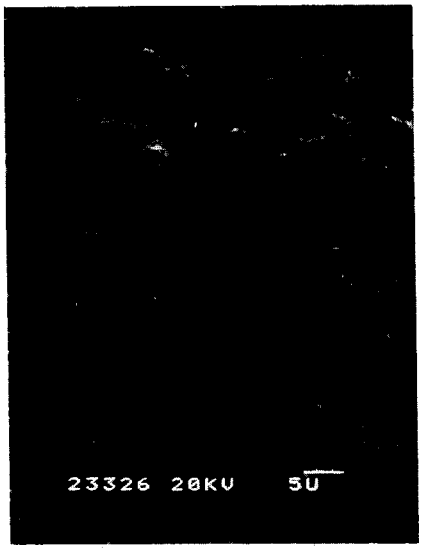

In FIGS. 4(*a*) and 4(*b*), microscopic pictures of the flat part of the cathode are given (magnification: ×890). FIG. 4(*a*) shows a state of binder dots of nickel powders, where the dots of somewhat coagulated nickel powders (due to the formation by spraying) are distributed discontinuously on the base metal. FIG. 4(*b*) shows a state of $BaZrO_3$ formation, wherein an oxide layer is laid on the base metal with nickel powders thereon, then the base metal is heated at 730° C. (operating temperature of cathode) for 1,000 hours, and then the oxide layer is removed therefrom for observation. Large blocks at the upper half of the picture are $BaZrO_3$ formed on the nickel powders, and small blocks at the lower half of the picture are $BaZrO_3$ formed on the base metal. Reason why $BaZrO_3$ is formed even on the base metal seems to be that, when the nickel powders are baked, the nickel is diffused and the diffused nickel serves to be a base for $BaZrO_3$ formation. The parts where the $BaZrO_3$ blocks are not formed seem to be the parts in which the nickel is not diffused. It is obvious from the foregoing that:

(1) Less amount of nickel powder is preferable, and such an amount as to firmly bind the oxide layer is sufficient. That is, the nickel powder should be distributed in dots in a discontinued manner, and (2) $BaZrO_3$ is more formed with increasing zirconium content, and thus less zirconium content can give a better effect upon the electron emission characteristics.

Figure 5:
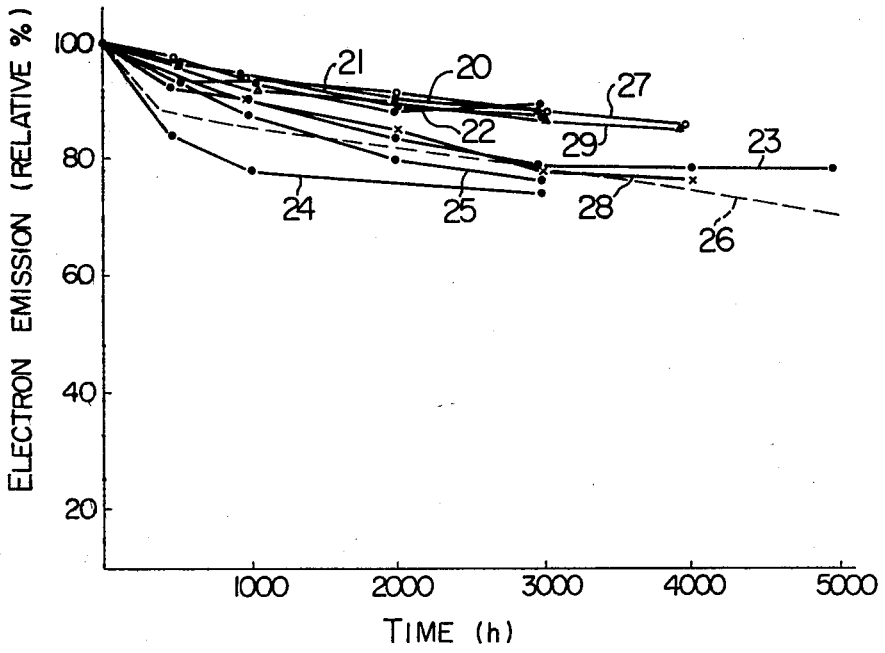
FIG. 5 is a diagram showing relations between an operating time of the cathode and an electron emission.

Results of measuring the electron emission characteristics by changing the amount of zirconium added are shown in FIG. 5, where the operating time of cathode is plotted on the abscissa, and the electron emission (relative %, based on the initial emission being 100%) on the ordinate. In FIG. 5, curve 20 shows a characteristic of a cathode having a composition of Ni-28W-0.07Zr, curve 21 that of Ni-28W-0.01Zr, curve 22 that of Ni-28W-OZr, curve 23 that of Ni-28W-0.18Zr, curves 24 and 25 that of Ni-28W-0.4Zr, curve 26 that of indirectly heated cathode, curve 27 that of Ni-28W-0.05Zr, curve 28 that of Ni-28W-0.1Zr, and curve 29 that of Ni-28W-trace amount of Zr. It is appropriate to regard the curves on a level equal to or superior to that of the indirectly heated cathode curve as being satisfactory, and thus the zirconium content of 0.4% by weight can be regarded as being too high, that is, as being not satisfactory.

Such a characteristic that the electron emission is abruptly lowered in a short time is not preferable, even if the absolute amount of lowering in the electron emission is small. That is, the base metal containing 0.4% by weight of zirconium is not preferable, because it has such a characteristic that the electron emission is abruptly lowered, for example, in a period of 0–1,000 hours in FIG. 5.

The cathode for electron tube must be also evaluated by taking another important characteristic, cut-off voltage, $\Delta E_{co}$ (V), into account. The cut-off voltage is an index showing a degree of thermal deformation of cathode. A lower cut-off voltage means less thermal deformation, that is, a more stable cathode. Deformation of a cathode degrades a color purity particularly in a color television picture tube of three-gun system, and thus less deformation is preferable.

Four sets of the same three test pieces each of the base metal compositions are tested in two operating periods of 500 hours and 1,000 hours, where a cut-off voltage of more than 2 V is regarded as unsatisfactory, and the results are given in Table 2.

Table 2

| Base metal composition | Number of unsatifactory pieces: After 500 hours | | After 1,000 hours | |
|---|---|---|---|---|
| Ni-28W-OZr | 3 | 2 | 3 | 2 |
| Ni-28W-trace amount of Zr | 0 | 0 | 0 | 0 |
| Ni-28W-0.01Zr | 0 | 0 | 0 | 0 |

Table 2-continued

| Base metal composition | Number of unsatifactory pieces: After 500 hours | | After 1,000 hours | |
|---|---|---|---|---|
| Ni-28W-0.05Zr | 0 | 0 | 0 | 0 |
| Ni-28W-0.07Zr | 0 | 0 | 0 | 0 |
| Ni-28W-0.1Zr | 0 | 0 | 0 | 0 |
| Ni-28W-0.18Zr | 0 | 0 | 0 | 0 |
| Ni-28W-0.4Zr | 1 | 0 | 1 | 1 |
| Ni-28W-0.4Zr | 2 | 1 | 1 | 1 |

It is obvious from Table 2 that the cathodes based on a base metal containing no zirconium is not appropriate, because of the high cut-off voltage, and the cathodes based on a base metal containing 0.4% by weight of zirconium sometimes show a fairly good characteristics and sometimes show unsatisfactory cut-off voltage. This means that it is difficult to produce a cathde having stable characteristics when the zirconium content is 0.4% by weight, this means, in other words, that the yield is poor. It can be said that the cathode of the present invention has less thermal deformation for a long operating time, as shown by the low cut-off voltage. It is obvious from the foregoing that the nickel diffusion as in said Japanese Laid-open Patent Application No. 108770/77 is not required in the present invention.

As described above, the formation of $BaZrO_3$ on the binder dots of metallic niclel powders can be suppressed by controlling the zirconium content of cathode base metal of tungsten-zirconium-nickel alloy to a trace amount to 0.25% by weight according to the present invention, whereby the electron emission characteristics can be stabilized and the cut-off voltage can be made smaller. Furthermore, a cathode having a particularly good electron emission characteristic and a low cut-off voltage can be obtained by further controlling the zirconium content of the cathode base metal to 0.05 to 0.8% by weight.

What is claimed is:

1. A directly heated cathode for electron tube, which comprises a base metal of an alloy consisting essentially of 20–30% by weight of tungsten and a trace amount to 0.25% by weight of zirconium, the balance being nickel, binder dots of metallic nickel powders distributed on a flat part at the front side of the base metal, and a layer of thermoelectron emission oxides laid on the flat part at the front side of the base metal, the layer of thermoelectron emission oxides being in direct contact with the flat part through clearances among the binder dots of metallic nickel powders.

2. A directly heated cathode for electron tube according to claim 1, wherein the zirconium content is 0.01–0.08% by weight.

3. A directly heated cathode for electron tube according to claim 1, wherein the metallic nickel powders are distributed as the binder dots at a rate of 0.1–5 $mg/cm^2$.

4. A directly heated cathode for electron tube according to claim 3, wherein the rate of the metallic nickel powders is 0.5–2 $mg/cm^2$.

5. A directly heated cathode for electron tube according to claim 1, wherein the metallic nickel powders have sizes of 4–7 $\mu m$.

6. A directly heated cathode for electron tube according to claim 1, wherein the tungsten content is 26–29% by weight.

* * * * *